US011242722B2

(12) United States Patent
Buffarini et al.

(10) Patent No.: US 11,242,722 B2
(45) Date of Patent: Feb. 8, 2022

(54) LOWER STACK ASSEMBLY OF A BLOW-OUT PREVENTER FOR A HYDROCARBON EXTRACTION WELL AND METHOD THEREOF

(71) Applicant: SAIPEM S.p.A., San Donato Milanese (IT)

(72) Inventors: Graziano Buffarini, San Donato Milanese (IT); Vito Fortunato, San Donato Milanese (IT)

(73) Assignee: SAIPEM S.p.A., Milan (IT)

( * ) Notice: Subject to any disclaimer, the term of this patent is extended or adjusted under 35 U.S.C. 154(b) by 0 days.

(21) Appl. No.: 16/649,215

(22) PCT Filed: Sep. 11, 2018

(86) PCT No.: PCT/IB2018/056902
§ 371 (c)(1),
(2) Date: Mar. 20, 2020

(87) PCT Pub. No.: WO2019/058210
PCT Pub. Date: Mar. 28, 2019

(65) Prior Publication Data

US 2020/0300056 A1 Sep. 24, 2020

(30) Foreign Application Priority Data

Sep. 21, 2017 (IT) ..... 102017000105614

(51) Int. Cl.
*E21B 33/064* (2006.01)
*E21B 33/035* (2006.01)
(Continued)

(52) U.S. Cl.
CPC ..... *E21B 33/064* (2013.01); *E21B 33/0355* (2013.01); *E21B 33/063* (2013.01); *E21B 41/04* (2013.01)

(58) Field of Classification Search
CPC .. E21B 33/064; E21B 33/0355; E21B 33/063; E21B 41/04
(Continued)

(56) References Cited

U.S. PATENT DOCUMENTS 6,484,806 B2 11/2002 Childers et al.
7,300,033 B1 11/2007 Whitby et al.
(Continued)

FOREIGN PATENT DOCUMENTS

WO 2014035975 A1 3/2014
WO 2014036430 A2 3/2014

OTHER PUBLICATIONS

International Search Report for International Patent Application No. PCT/IB2018/056902, dated Jan. 3, 2019, 4 pages.

*Primary Examiner* — Matthew R Buck
*Assistant Examiner* — Patrick F Lambe
(74) *Attorney, Agent, or Firm* — Armstrong Teasdale LLP

(57) ABSTRACT

A lower stack assembly of a blowout preventer for a hydrocarbon extraction well includes a safety function that can be hydraulically activated to rapidly cut off a pipeline section. The assembly includes a first valve and a first fluidic connection connecting the first valve and the least one safety function, so that the first valve selectively cuts off a flow of fluid directed towards the safety function. The assembly further includes a port operatively connected to the first valve, cooperating with a remotely operated vehicle to transmit a pilot signal to the first valve, an accumulator housing pressurized fluid, and a second fluidic connection. By cooperating with the first valve, the accumulator supplies pressurized fluid to the safety function to activate it. The second fluidic connection connects the accumulator and the first valve, so that the second fluidic connection remains operative during the entire working life of the assembly.

9 Claims, 7 Drawing Sheets

(51) Int. Cl.
*E21B 33/06* (2006.01)
*E21B 41/04* (2006.01)

(58) Field of Classification Search
USPC ..... 166/363
See application file for complete search history.

(56) References Cited

U.S. PATENT DOCUMENTS

| | | | | |
|---|---|---|---|---|
| 9,234,400 | B2 | 1/2016 | Warnock, Jr. et al. | |
| 9,970,287 | B2 * | 5/2018 | Jaffrey | E21B 33/062 |
| 2009/0095464 | A1 | 4/2009 | McGrath et al. | |
| 2010/0006298 | A1 | 1/2010 | Voss et al. | |
| 2012/0205561 | A1 | 8/2012 | Baugh | |
| 2014/0124211 | A1 | 5/2014 | Warnock, Jr. et al. | |
| 2016/0319622 | A1 | 11/2016 | Mcauley et al. | |

* cited by examiner

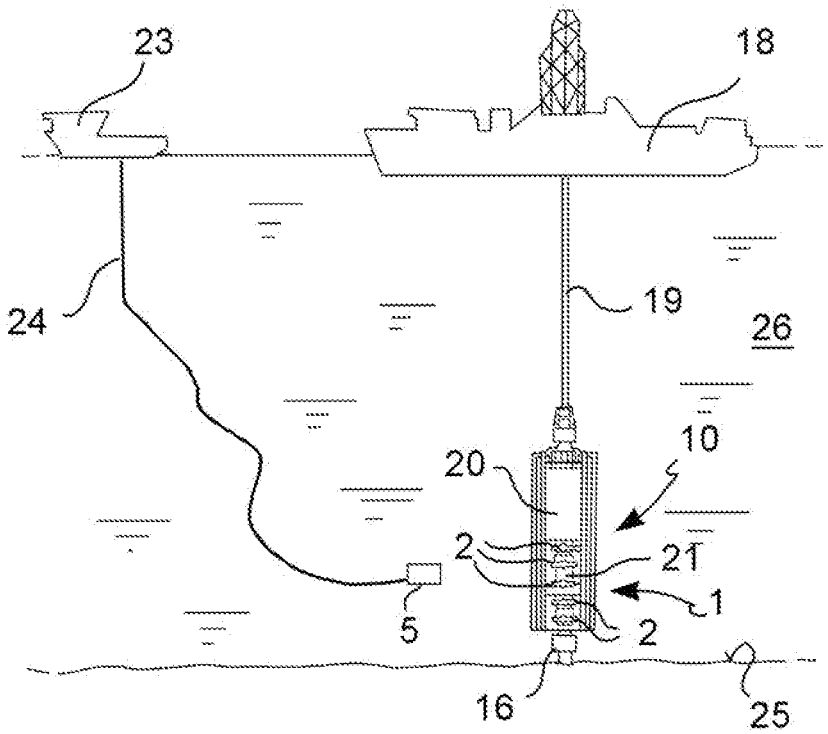
FIG.1
FIG. 1bis
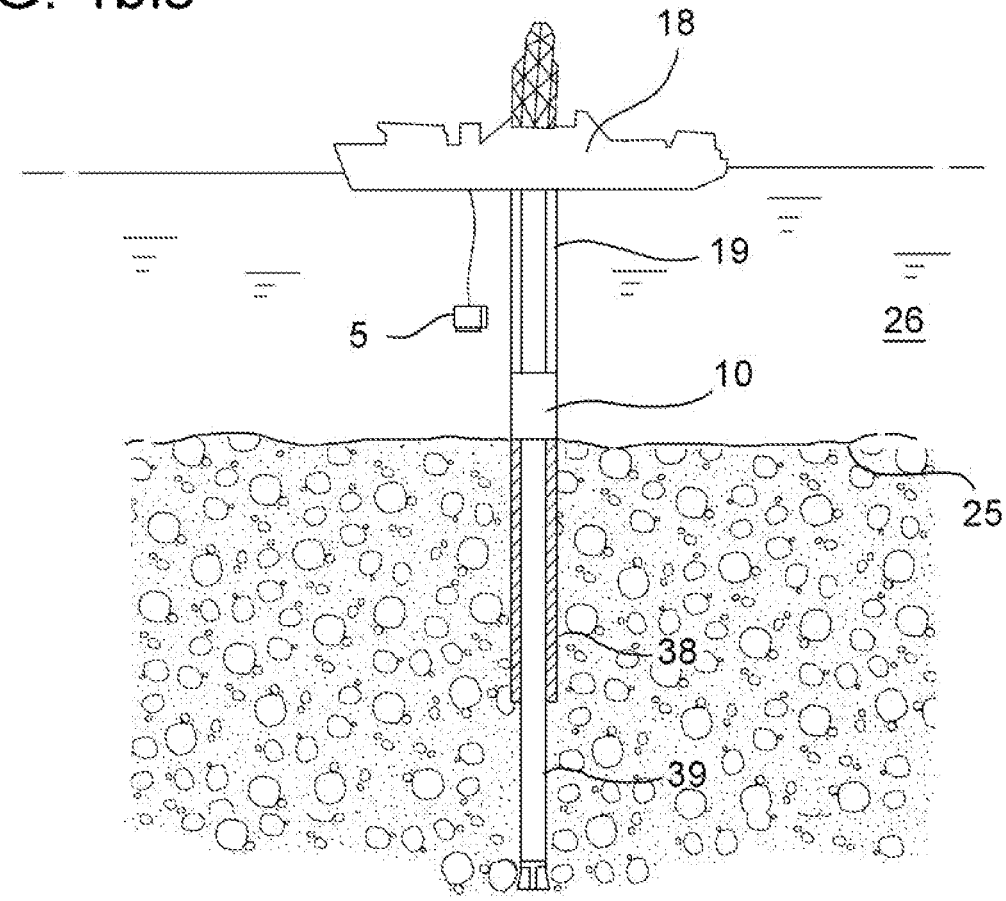

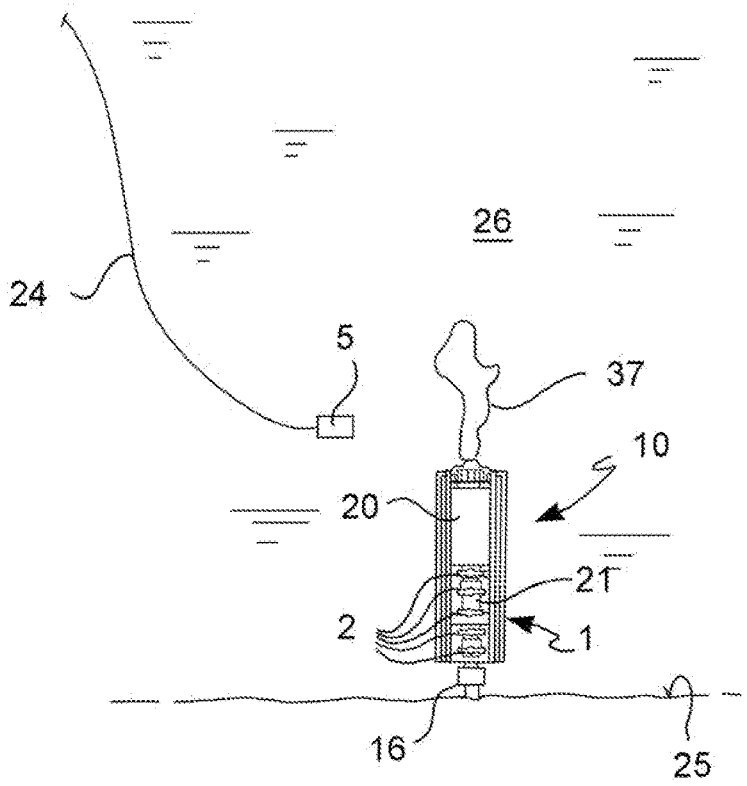
FIG.2
FIG. 3
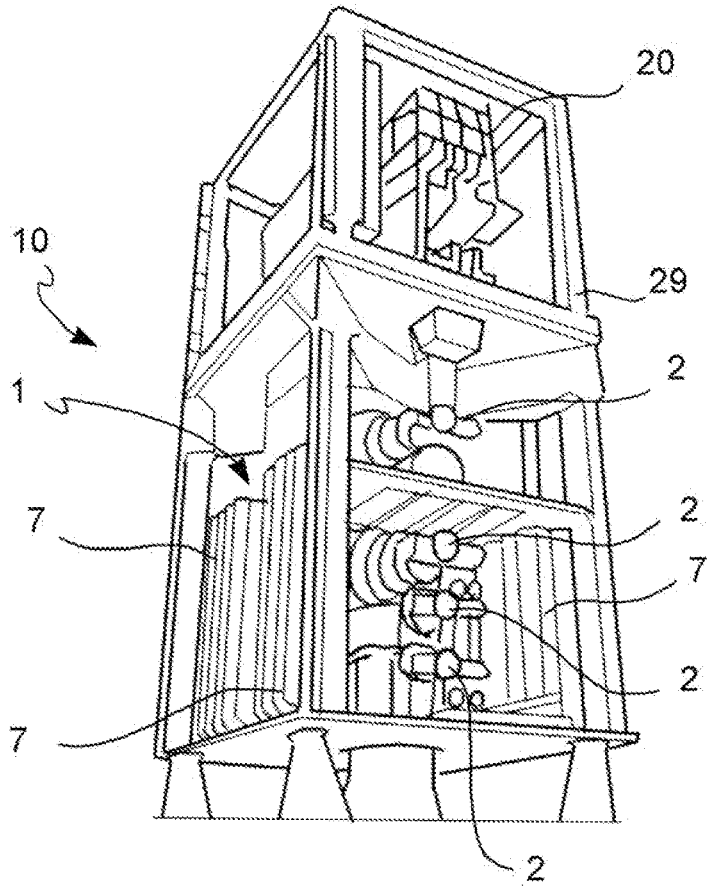

LOWER STACK ASSEMBLY OF A BLOW-OUT PREVENTER FOR A HYDROCARBON EXTRACTION WELL AND METHOD THEREOF

CROSS-REFERENCE TO RELATED APPLICATIONS

This application is a National Phase Application of PCT International Application No. PCT/IB2018/056902, having an International Filing Date of Sep. 11, 2018 which claims priority to Italian Application No. 102017000105614 filed Sep. 21, 2017, each of which is hereby incorporated by reference in its entirety.

FIELD OF THE INVENTION

The present invention relates to a lower stack assembly of a blowout preventer for a hydrocarbon extraction well.

The present invention also relates to a blowout preventer for a hydrocarbon extraction well.

Moreover, the present invention relates to a method for activating a safety function of a lower stack assembly of a blowout preventer for a hydrocarbon extraction well.

BACKGROUND

Hydrocarbons are usually extracted through a generally vertical well which connects the oilfield to the seabed. The well consists of a borehole lined by a series of concentric pipes (known as casings). The stability of such casing is guaranteed by a wellhead fixed to the surface of the bed by means of foundations, which can be piled and/or cemented. The borehole is made by means of a rotating drilling rod, which originates from the drilling means and on the lower part of which the mandrel is positioned. The drilling operation is performed in conjunction with the descent of an outer pipe ("riser") which separates and provides a gap for the drilling rod and in conjunction with the descent of the casings. The removed material is conveyed and cleared out by circulating the drilling mud, which circulation performs various functions such as lubricating, conveying to the surface, applying a hydrostatic counter-pressure on the bottom of the hole which makes it possible to balance any unexpected unforeseen movements of formation fluid ("kicks").

The hydrocarbons contained and trapped inside the oilfields rise naturally because of their weight, which is lighter than that of the surrounding environment. Violent blowouts, which generally draw gas, hydrocarbons, water and sand, may occur if the pressure difference is particularly high. The phenomenon may be particularly rapid and violent, with spilling of the product from the well. In order to control the spilling phenomenon, safety devices, such as shut-off valves (named blowout preventers, or BOPs) which act in the event of need as a barrier to cut off the fluid connection between wellhead and drilling system.

Blowout preventers must allow the temporary detachment of the drilling means from the well, for different reasons, e.g. such as bad weather and sea conditions or loss of position of the ship. This function is implemented by two components and in particular by a lower stack (also known as BOP lower stack) connected to the wellhead and a lower marine riser package (or LMRP), which contains the pods of the lower stack and the upper part of which is connected to the riser inside which the drill string is inserted. Some examples of known safety devices or BOPs are shown in documents U.S. Pat. Nos. 6,484,806, 7,300,033 and US-2010-0006298.

Known safety devices comprise a series of hydraulically activated rams, which have various functions, such as that of sealing the gap sections between drilling rod and casing or cutting the drilling rod and completely cutting off the well, to cut off the oilfield and prevent the spilling of hydrocarbons. Known solutions of the rams comprise variable bore rams for closing and sealing around the drilling rod, shear rams and blind shear rams.

The need is therefore strongly felt for the ram driving system to be able to provide reliable and fast response, even under fault conditions.

The rams of the safety device are actuated by means of a system which consists of hydraulic and electric power generators, and by a control positioned on the drilling means. The hydraulic power and electric signals are transferred to the lower marine riser package by means of redundant lines. The lower marine riser package also consists of a redundant pod which manages the actuating logics of the valves of the lower marine riser package components. The electro-hydraulic connection between lower marine riser package and lower stack is achieved by means of rigid and flexible pipelines. Given the criticality of the component, the system contains a number of redundancies often sufficient to ensure a given minimum level of safety in some predictable emergency situations.

Known safety devices comprise various types of redundancies which are activated selectively according to the degree of criticality, e.g. such as the malfunction of said pods and/or in the event of loss of connection with the drilling means, as shown, for example, in document US-2014-0124211.

The secondary system is usually configured to be activated by means of a remotely operated vehicle or ROV, whereby avoiding having to actuate the secondary emergency system using the drilling means. An example of remotely operated vehicle is shown in document U.S. Pat. No. 9,234,400, in which such remotely operated vehicle is equipped with auxiliary pumps. A problem of the ROV-based emergency systems is related to the low power supplied by the ROV and its auxiliary modules, which cannot operate the devices promptly in the time required by the spilling phenomenon.

For example, document US-2009-095464 shows a secondary emergency system solution which uses a ROV to maneuver and connect flying leads to form a connecting system, whereby bypassing the primary control. Each flying lead is handled and connected by the ROV to the lower stack. These flying leads may be positioned on the BOP in a resting position and are secured to the structure of the BOP with easily removable fixings so as to allow recovering it in case of an emergency. The flying leads can be inserted by means of conventional connectors called hot stabs, which are inserted on the receptacle part of the system, which is typically inserted in an intervention panel which simplifies the driving by means of ROV. The structural flexibility of the flying lead makes it possible to wrap it, when the secondary emergency system is not in use, i.e. in normal operation conditions of the safety device, about a portion of the body of the safety device to prevent the flying end of the lead from fluctuating in the body of water subject to sea currents, whereby making it difficult to be gripped by the ROV.

This type of solution requires the remotely operated vehicle or ROV to maneuver the flying lead to unwind it and to subsequently connect the flying end of the lead to the ram activation circuit, whereby expanding the intervention and activation times of the secondary emergency system. Additionally, particularly in conditions of poor visibility, e.g. such as in conditions of spilling of the well contents, the maneuvering operation of the flying lead performed by the ROV may tear the wall made of flexible material of the flying lead itself, whereby making the bypass connection ineffective. Additionally, the flying lead is sometimes subject to breakage, e.g. to bursting, by effect of the hydraulic pressure of the process fluid that it receives, and may be damaged due to high hydrostatic pressure of the undersea environment, particularly in near the seabed.

Furthermore, the flying lead is commonly used to connect a portion of the lower marine riser package to the lower stack, e.g. as shown in document US-2016-0319622. It is impossible to activate this type of solution in case of detachment of the lower marine riser package from the lower stack, detachment which can be caused by several factors, which may sometimes converge, e.g. bad weather and sea conditions, uncontrollable blowout of hydrocarbons from the oilfield, or malfunction of the positioning system of the drilling ship.

The need is thus felt to provide a solution for the drawbacks mentioned with reference to the prior art.

The need is strongly felt to provide a secondary emergency system solution improved reliability with respect to known solutions, without because of this being slow to activate.

The need is strongly felt to provide a secondary emergency system solution having improved operation promptness and activation rapidity.

The need is strongly felt to provide a secondary emergency system solution with improved reliability even in critical or catastrophic conditions, e.g. in uncontrollable hydrocarbons blowout conditions from the oilfield and/or in conditions of detachment of the lower marine riser package from the lower stack of the blowout preventer.

SUMMARY

It is an object of the present invention to solve the drawbacks of the prior art described hereto.

These and other objects are achieved by the lower stack assembly, the blowout preventer and the method for activating a safety function for rapidly cutting off a pipeline section described below.

Some advantageous embodiments are also described.

BRIEF DESCRIPTION OF THE DRAWINGS

Further features and advantages of BOP lower stack assembly, of the blowout preventer and of the method according to the invention will be apparent from the description provided below of preferred embodiments thereof, given by way of non-limiting examples, with reference to the accompanying drawings, in which:

FIG. 1 is a view (not in scale) which shows a blowout preventer according to an embodiment, in normal operating conditions and when connected to drilling means;

FIG. 1*b* is a view (not in scale) which shows a blowout preventer in normal operating conditions, according to an embodiment of the invention;

FIG. 2 diagrammatically shows the blowout of the content of the hydrocarbon extraction well from the blowout preventer, in faulty conditions, and a remotely operated vehicle;

FIG. 3 shows an axonometric view of a blowout preventer, according to an embodiment, comprising a lower stack assembly and a lower riser marine package;

Figure 4:
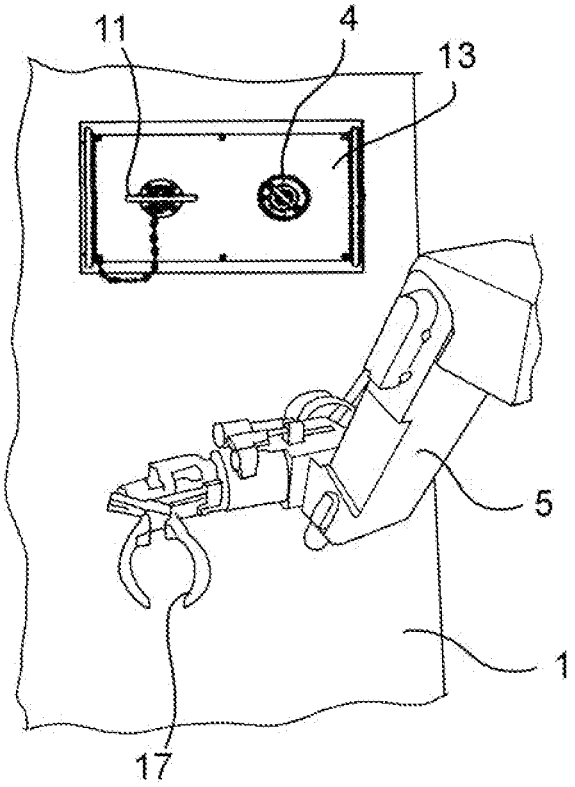
FIG. 4 shows manipulator type of a remotely operated vehicle near the control panel, according to an embodiment of the invention.
Figure 5:
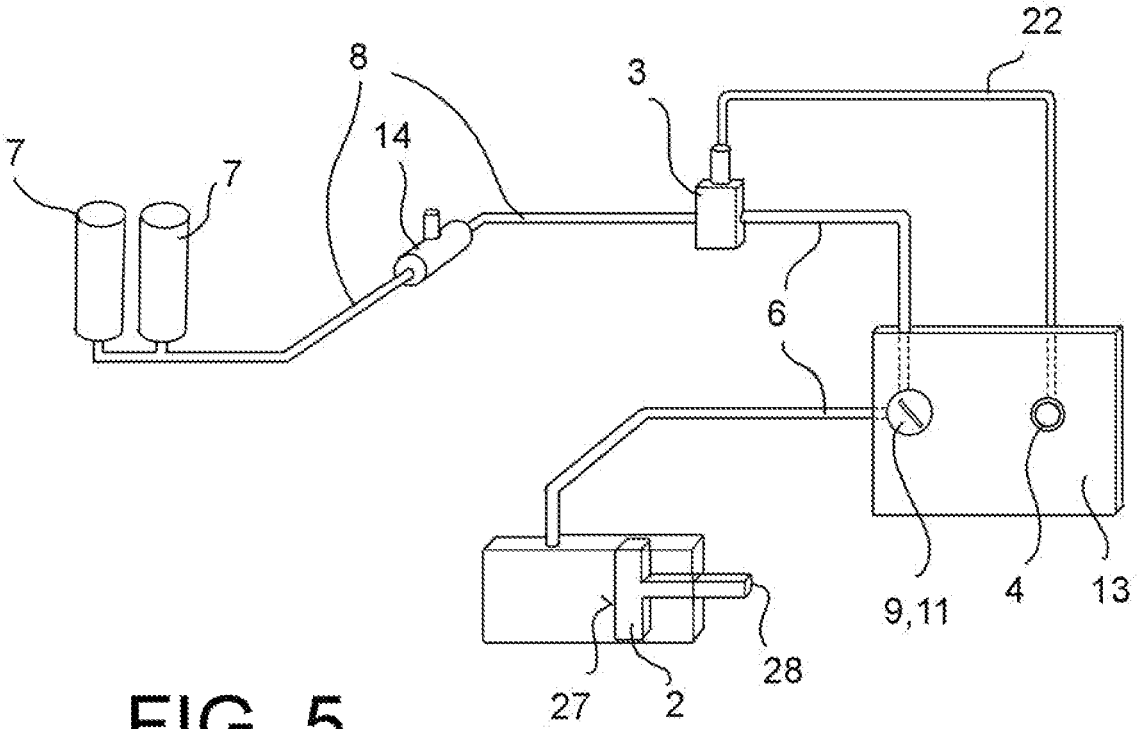
FIG. 5 diagrammatically shows a shear ram activation circuit, according to an embodiment of the invention.
Figure 6:
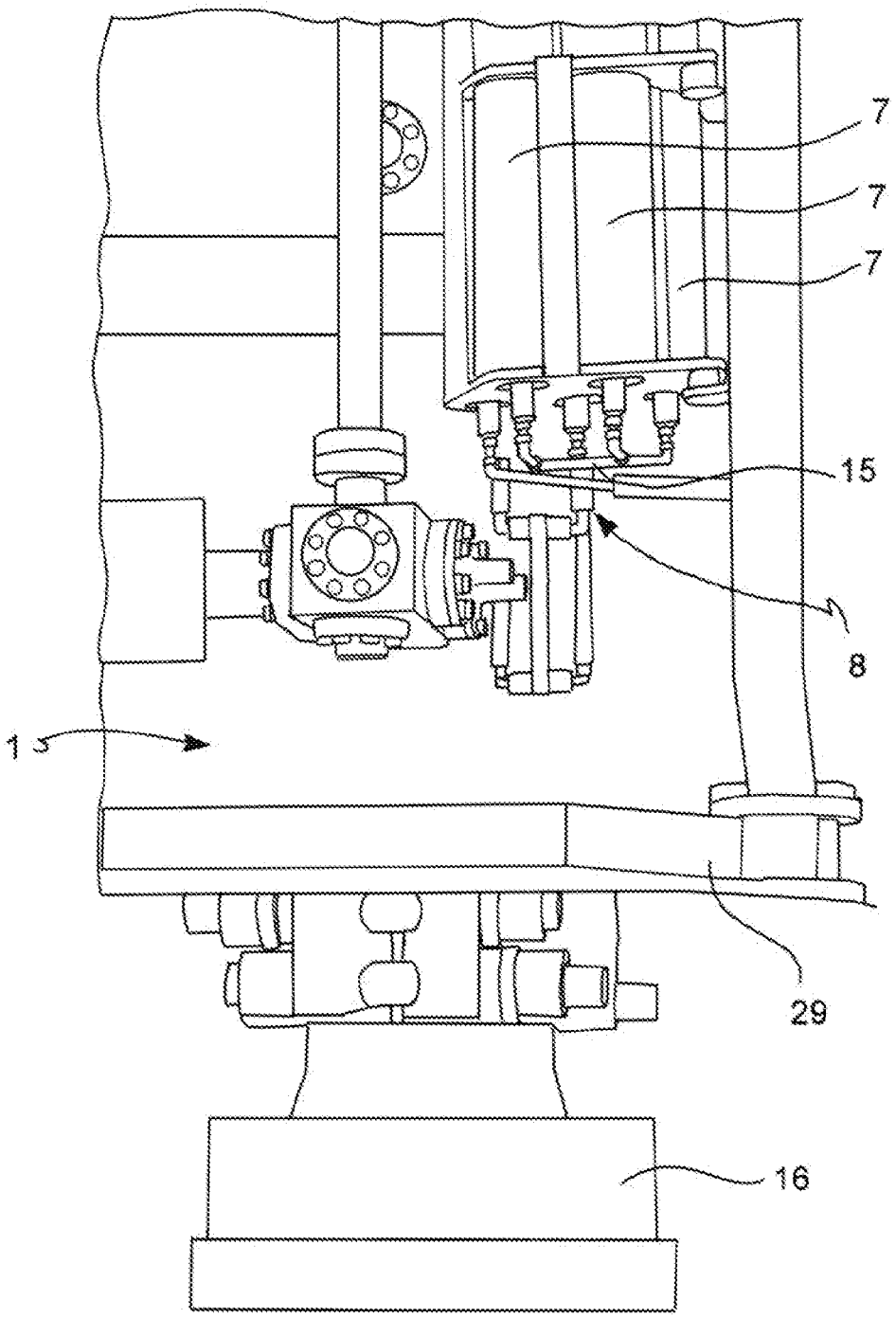
FIG. 6 shows a portion of a lower stack assembly, according to an embodiment.
Figure 7:
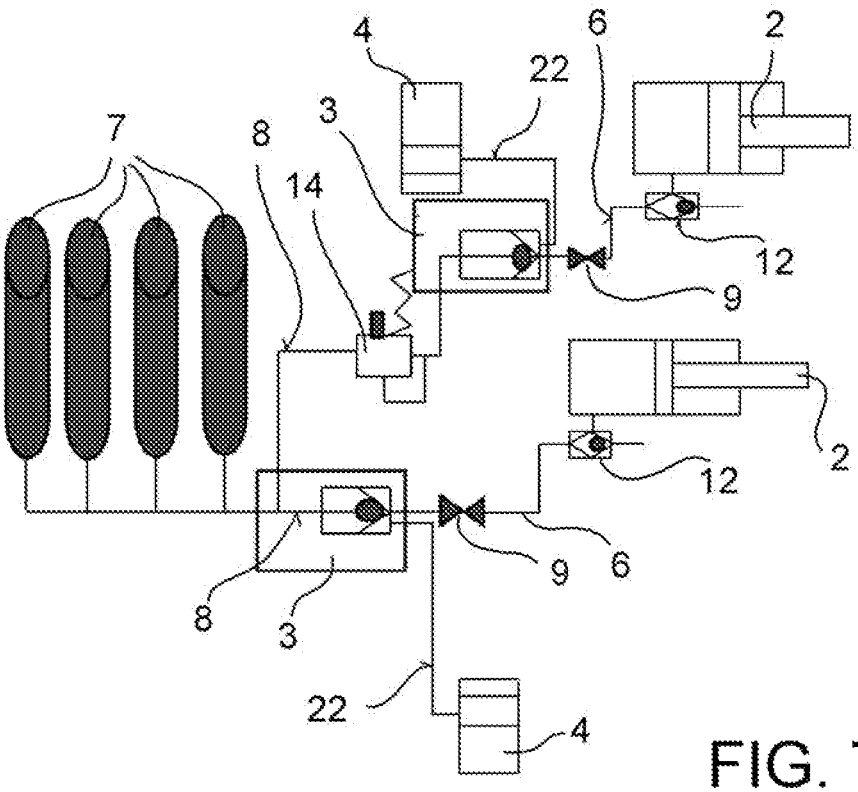
Figure 8:
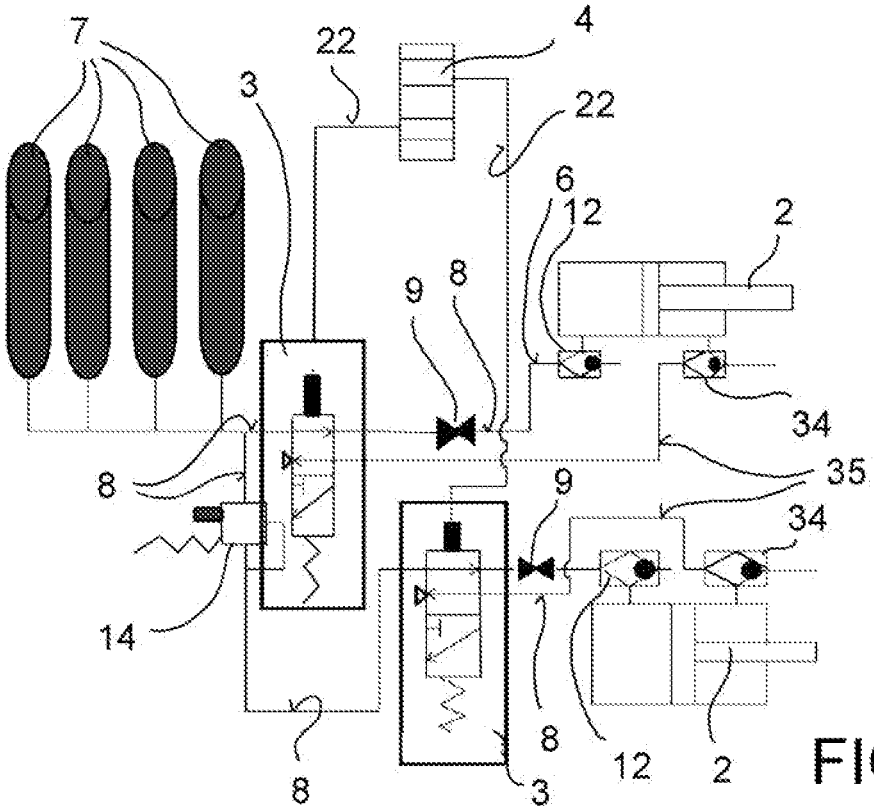
Figure 9:
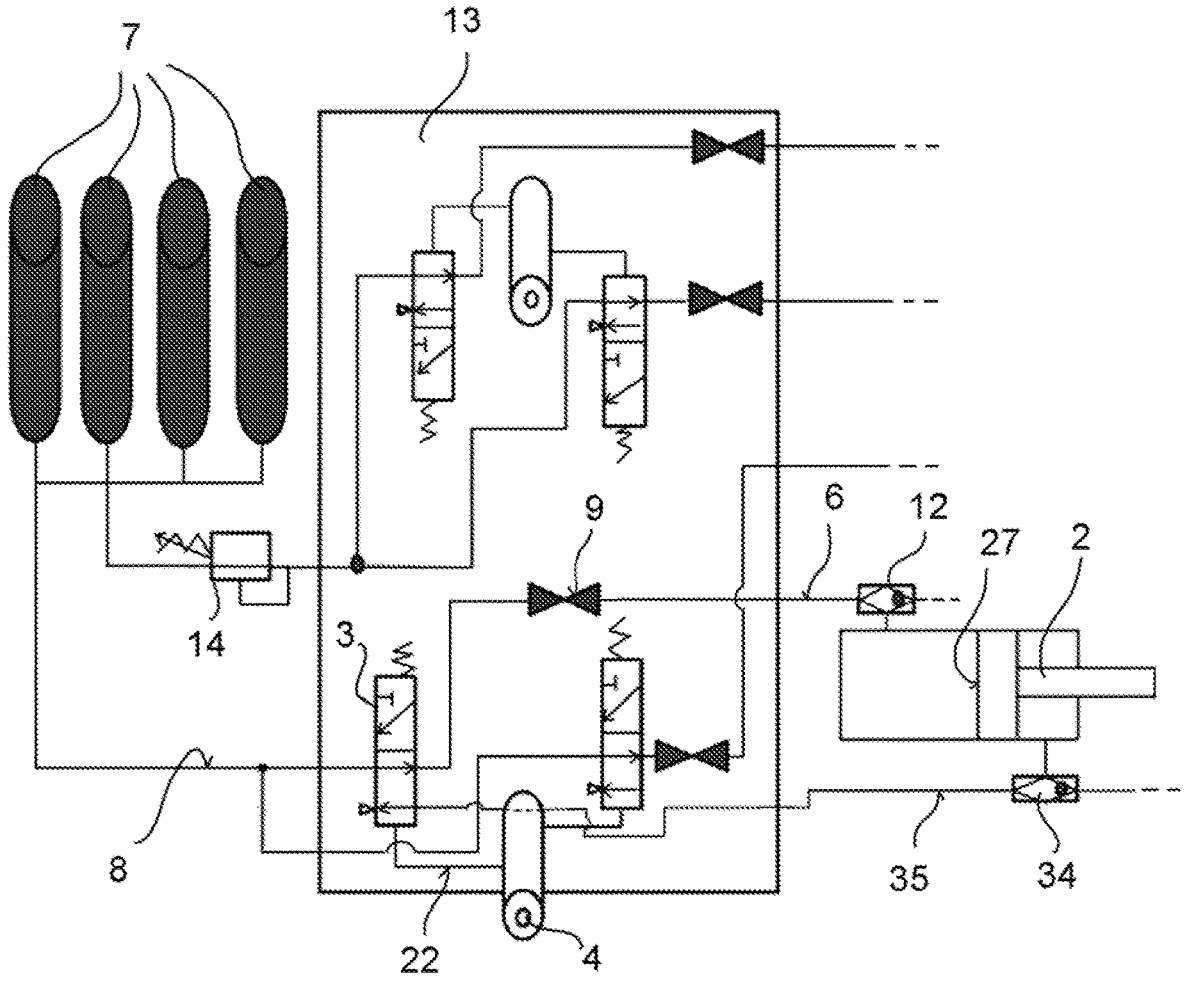
Figure 10:
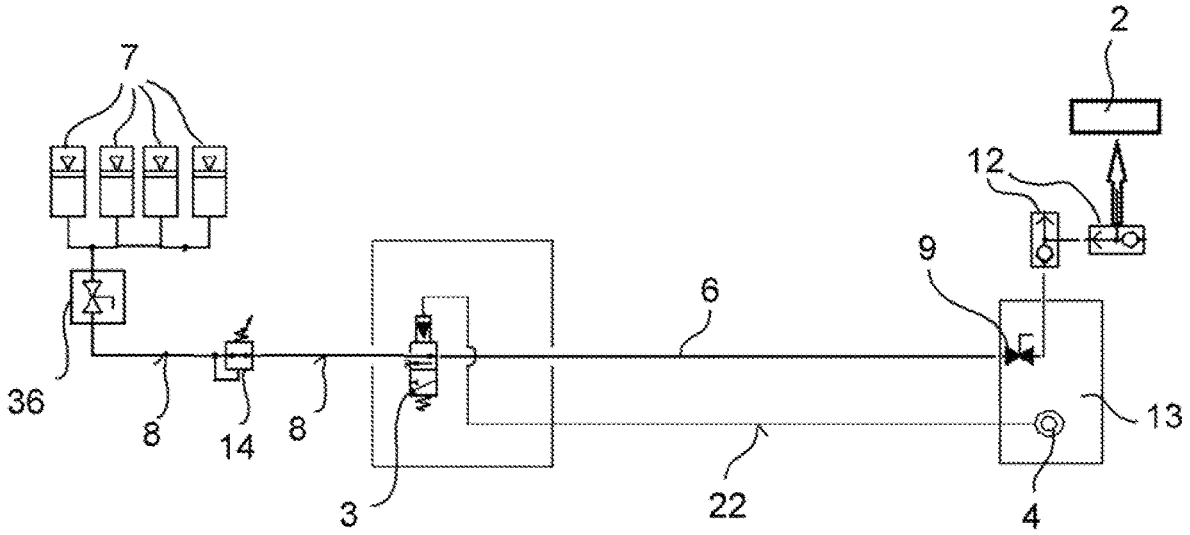
Figure 11:
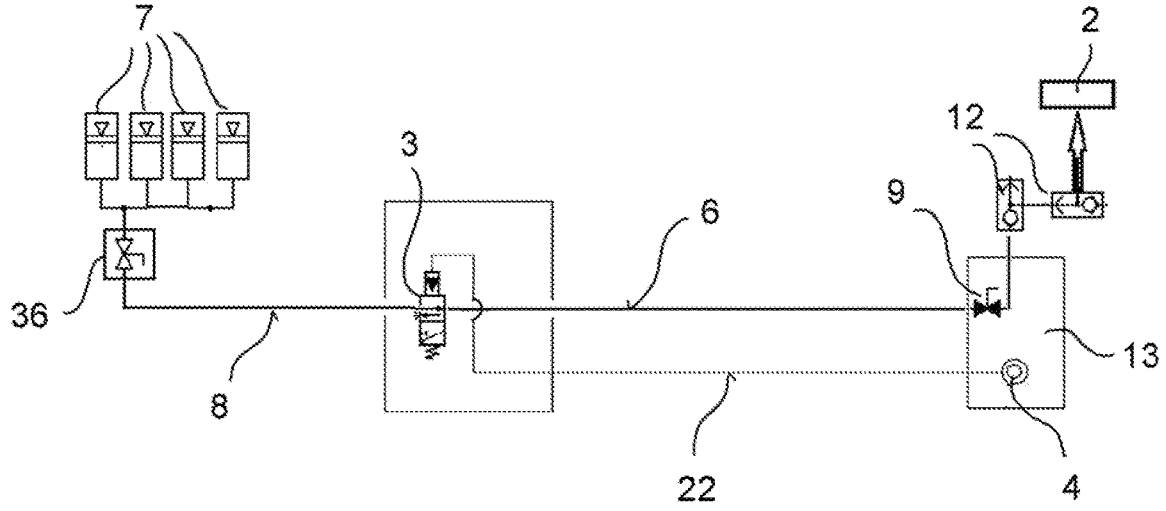

figures from 7 to 11 are diagrams which show the activation circuitry of at least one safety function, according to some embodiments.

DETAILED DESCRIPTION

According to a general embodiment, a lower stack assembly 1 or lower stack 1 or BOP lower stack 1 of a blowout preventer 10 or BOP 10 for a hydrocarbon extraction well is provided.

Said lower stack assembly 1 of a blowout preventer 10 is particularly adapted but not unequivocally intended for application in submerged, e.g. subsea environment, wherein said hydrocarbon extraction well is dug in the bed 25 of a body of water 26.

Said lower stack assembly 1 comprises at least one safety function 2 which can be hydraulically activated to rapidly cut off a pipeline section. According to an embodiment, said safety function 2 comprises at least one shear ram, adapted to cut a pipeline section. According to an embodiment, said safety function 2 can be activated by pressurized fluid. According to an embodiment, said safety function 2 is housed in the cavity of an internally hollow body and comprises an abutment portion 27, adapted to receive a thrust action applied by the pressurized fluid like a piston housed in a cylinder, and a shearing portion 28, opposite to said abutment portion 27 and adapted to rapidly cut off a pipeline segment 21.

Said lower stack assembly 1 comprises at least one first valve 3.

According to an embodiment, said first valve 3 is a pilot-operated valve. According to an embodiment, said first valve 3 is a one-way valve. According to an embodiment, said first valve 3 is a ball check valve, preferably of the normally-closed type. According to an embodiment, said first valve 3 is a slide check valve, preferably of the normally-closed type.

According to an embodiment, said first valve 3 is a valve adapted to intercept a fluid flow. According to an embodiment, said first valve 3 is a check valve.

Said lower stack assembly 1 comprises at least one first fluidic connection 6 which connects in permanent manner said at least one first valve 3 and said at least one safety function 2, so that said at least one first valve 3 is adapted to selectively intercept a fluid flow directed towards said at least one safety function 2.

According to an embodiment, said first fluidic connection 6 remains operational during the entire working life of the assembly 1. The expression "working life" does not also indicate maintenance interventions which may require the temporary detachment of the fluid connection.

According to an embodiment, said first fluidic connection 6 is formed by at least one rigid wall pipeline.

Said lower stack assembly 1 comprises at least one port 4 operatively connected to said at least one first valve 3, said at least one port 4 being adapted to cooperate with a remotely operated vehicle 5 to transmit a pilot signal to said at least one first valve 3. According to an embodiment, said remotely operated vehicle 5 is a remotely operated underwater vehicle 5 or ROV 5. According to an embodiment, said remotely operated vehicle 5 is operatively connected to a support vessel 23, e.g. by means of an umbilical cable 24 of the ROV for the supplying power and/or for exchanging information and/or controls.

Said lower stack assembly 1 comprises at least one accumulator 7 adapted to house the pressurized fluid. According to an embodiment, said at least one accumulator 7 houses a sufficient volume of high-pressure fluid to actuate the rams of the BOP.

Said lower stack assembly 1 comprises at least one second fluidic connection 8 between said at least one accumulator 7 and said first valve 3, so that said at least one accumulator 7 by cooperating with at least said first valve 3 is adapted to supply pressurized fluid, by means of said second fluidic connection 8 and said first fluidic connection 6, to said at least one safety function 2 to activate it.

Advantageously, said at least one second fluidic connection 8 connects in permanent manner said at least one accumulator 7 and said at least one first valve 3, so that said second fluidic connection 8 remains operative during the entire working life of the assembly 1.

By providing said at least one second fluidic connection 8 which connects in permanent manner said at least one accumulator 7 and said at least a first valve 3, a circuitry is provided which is already built and simply to be activated in emergency conditions. In other words, spending time in emergency conditions to construct a circuitry is avoided. In this manner, a secondary emergency system which can be readily activated can be made.

According to an embodiment, said second fluidic connection 8 remains operational even in the event of detachment of a lower marine riser package 20 or LMRP 20 associable with said lower stack assembly 1. In this manner, a rapid activation of the secondary emergency system is allowed also in critical or catastrophic conditions.

According to an embodiment, said second fluidic connection 8 is formed by at least one rigid pipeline 15. According to an embodiment, said second fluid connection 8 is formed by at least one rigid pipeline 15 at least partially made of steel for subsea pipelines suited to the conditions of use.

According to an embodiment, said port 4 is associated with a pilot valve, adapted to provide a pilot signal to said first valve 3. In this manner, by cooperating with said port 4, said remotely operated vehicle 5 transmits said pilot signal to said first valve 3, whereby quickly activating it.

According to an embodiment, said pilot signal is a fluid flow. According to an embodiment, said pilot fluid flow is supplied from said remotely operated vehicle 5.

Preferably, said remotely operated vehicle 5 comprises at least one driving fluid reservoir which accommodates said driving fluid, and at least one working portion 17, or manipulator 17, which transmits said pilot signal, preferably said driving fluid flow to said port 4. According to an embodiment, said manipulator 17 is formed of a manipulator having a plurality of degrees of freedom. According to an embodiment, said manipulator 17 can manage a hot stab type connector which connects the driving reservoir and which transmits said pilot signal, preferably said driving fluid flow, to said port 4.

According to an embodiment, said pilot signal is a pressurized fluid flow. According to an embodiment, said pilot signal is a fluid flow having lower pressure than the pressure of the fluid housed in said at least one accumulator 7. For example, the pressure of the fluid flow which forms the pilot signal is substantially equal to 20 MegaPascals (MPa), i.e. approximately equal to 3000 pound per square inch (psi). For example, the pressure of the fluid housed in said at least one accumulator 7 is substantially equal to 35 MegaPascal, i.e. approximately equal to 5000 psi.

According to an embodiment, said assembly 1 comprises a third fluidic connection branch 22 which forms a permanent fluidic connection between said port 4 and said first valve 3.

According to an embodiment, said first fluidic connection 6 is formed by at least one portion of a pipe. Preferably, said at least one pipe which forms said first fluid connection 6 has a diameter of about 2.54 cm, substantially equal to one inch.

According to an embodiment, said second fluidic connection 8 is formed by at least one portion of a pipe. Preferably, said at least one pipe which forms said second fluid connection 8 has a diameter of about 2.54 cm, substantially equal to one inch. According to an embodiment, said assembly 1 comprises a plurality of accumulators 7 and said first fluid connection 8 branches into a plurality of accumulator branches, each accumulator branch being fluidically connected to at least one accumulator 7 of said plurality of accumulators.

According to an embodiment, said third branch 22 is formed by at least one portion of at least one pipe. Preferably, said at least one pipe which forms said third fluid connection 22 has a diameter of about 0.64 cm, substantially equal to 0.25 inches.

According to an embodiment, the at least one pipe which forms said third branch 22 has a diameter smaller than the diameter of at least one of the at least one pipe which forms said first fluid connection 6 and at least one pipe which forms said second fluidic connection 8.

According to an embodiment, said pilot signal is an electric or electromagnetic signal. Preferably, said electric or electromagnetic pilot signal is supplied by said remotely operated vehicle 5. In this manner, a first valve can be operated quickly is provided.

According to an embodiment, said first fluidic connection 6 comprises at least one second valve 9.

According to an embodiment, said second valve 9 is adapted to intercept a flow of fluid coming from said at least one accumulator 7 and/or directed towards said at least one safety function 2. According to a preferred embodiment, said second valve 9 is an shut-off valve. Preferably, said first valve 9 is a ball shut-off valve.

According to a preferred embodiment, said second valve 9 is an isolation valve. According to an embodiment, said second valve 9 is a shutter valve.

According to an embodiment, said second valve 9 can be controlled by means of a second valve control device 11. According to an embodiment, said second valve control device 11 is a control lever, adapted to be handled by a ROV 5. According to an embodiment, said second valve control device 11 can be controlled independently by said port 4.

According to an embodiment, said assembly 1 comprises at least one control panel 13 comprising said port 4 and said second valve control device 11, so that said remotely operated vehicle 5 is adapted to cooperate both with said port 4 and with said second valve control device 11 to activate said at least one safety function 2.

According to an embodiment, said first fluidic connection 6 comprises at least one third valve 12. According to an embodiment, said third valve 12 is a selector valve. Providing said at least one third valve 12 makes it possible to selectively convey the fluid coming from said at least one accumulator 7 to the safety function 2.

According to an embodiment, said assembly 1 comprises at least one emptying branch 35 comprising at least one fourth valve 34, or emptying valve 34, wherein said emptying branch 35 is arranged downstream of said safety function 2 and is adapted to allow an emptying fluid flow of said safety function. According to an embodiment, said at least one fourth valve 34 is a selector valve and, when open, it is adapted to allow emptying the process fluid from the safety function 2.

According to an embodiment, said at least one emptying branch 35 is adapted to put into fluid communication said safety function 2 and said first valve 3, whereby returning the emptying fluid flow of the safety function 2 to said first valve 3. According to an embodiment, said at least one emptying branch 35 conveys the output fluid flow from said safety function 2 and, by means of said first valve 3, conveys it into said water body.

According to an embodiment, said second fluidic connection 8 comprises at least one pressure regulator 14 which regulates the fluid pressure let out from said at least one accumulator 7. According to an embodiment, said at least one pressure regulator 14 decreases the fluid pressure let out from said at least one accumulator 7. By way of non-limiting example, the pressurized fluid stored in said at least one accumulator 7 has a pressure of 35 MegaPascal, substantially equal to 5000 psi and said pressure regulator 14 decreases the pressure let out from said at least one accumulator 7 to about 20 MegaPascals, which is substantially equal to 3000 psi.

According to an embodiment, said second fluid connection 8 comprises at least one shut-off valve at the outlet of the accumulator 36, preferably interposed between said at least one accumulator 7 and said pressure regulator 14.

According to an embodiment, said lower stack assembly 1 comprises a structural frame 29 which forms a supporting armature for the functional elements of the assembly 1. According to an embodiment, said structural frame 29 comprises at least one portion for connecting to the lower marine riser package 20, adapted to form a removable mechanical connection with said structural frame 29.

According to an embodiment, said assembly 1, preferably said structural frame 29 of the assembly 1, comprises at least one wellhead connection element 16, adapted to put the contents of the hydrocarbon extraction well into fluid communication with a riser 19. For example, said wellhead connection element 16 is made by means of commercial connectors to the wellhead.

According to an embodiment, said assembly 1, preferably said structural frame 29 of the assembly 1, delimits a housing for accommodating at least one pipeline section 21 which puts the contents of the hydrocarbon extraction well into fluid communication with a riser 19. Preferably, said structural frame 29 delimits a housing to accommodate a drilling rod 39 operatively connected to the drilling means 18. Preferably, said drilling rod 39 is associated with a casing 38.

According to an embodiment, said drilling rod 39 is integral with said pipeline section 21. According to an embodiment, riser 19 is connected by one of its ends to drilling means 18, e.g. a drilling vessel 18 or a drilling platform. According to an embodiment, said riser 19 cooperates with said pipeline section 21 to put the contents of the hydrocarbon extraction well into fluid communication with the drilling means 18.

According to an embodiment, said structural frame 29 is fitted on the said pipeline section 21.

According to an embodiment, said at least one safety function 2 is adapted to cut off the fluidic communication between the contents of the hydrocarbon extraction well and said riser 19, preferably by cutting and/or tearing the casing 38 of said riser 19 and said pipeline section 21, and forming a barrier which prevents the spilling of the contents of the hydrocarbon extraction well 37. For example, a blowout of the content of the well 37 is diagrammatically shown in FIG. 2.

According to an embodiment, said at least one safety function 2 is adapted to cut a portion of said pipeline section 21. Preferably, said safety function 2 comprises a cutting portion 28 comprising at least a cutting device for cutting a portion of said pipeline section 21.

According to an embodiment, said assembly 1 comprises a plurality of safety functions 2. For example and in a known manner, said plurality of safety functions 2 comprises at least one shear ram, at least one blind shear ram or at least one pair of blind shear rams. Preferably, each ram consists of two opposite cutting elements which are operated by two distinct hydraulic circuits.

According to an embodiment, the functions of said plurality of safety functions 2 can be operated in mutually independent manner. According to an embodiment, said assembly comprises a plurality of ports 4, so that each port 4 controls a safety function 2.

According to an embodiment, the functions of said plurality of safety functions 2 can be activated simultaneously by the same port 4 and/or by the same control procedure.

According to a general embodiment, a blowout preventer 10 for a hydrocarbon well comprises at least one lower stack assembly 1 according to any one of the embodiments described above.

According to an embodiment, said blowout preventer 10 comprises at least one lower marine riser package 20 removably connected to said lower stack assembly 1 and, by means of a riser 19, to drilling means 18 associable with said blowout preventer 10.

According to an embodiment, said lower stack package 20 comprises at least one primary pod, which is usually redundant with a secondary pod to increase system reliability. Preferably, such primary and secondary pods activate the valves and hydraulic branches according to the intervention logics set on the surface by the central control, and in particular, are adapted to receive control fluid to activate said at least one safety function 2 and adapted to cooperate with a control system, preferably located on said drilling means 18, adapted to send control signals to said pods to activate said safety functions 2, whereby forming a primary control system.

According to an embodiment, said lower stack package 20 comprises at least one LMRP frame, adapted to form a removable mechanical connection with said structural frame 29 of said lower stack assembly 1.

According to an embodiment, said lower stack package 20 comprises at least one pipeline end in fluid communication with said riser 19, preferably made in one piece with said riser 19, which connects in a removable manner to said pipeline section 21 which crosses said assembly 1.

A method for activating a safety function 2 for rapidly cutting off a pipeline section 21 is described below.

A method for activating a safety function 2 for rapidly cutting off a pipeline section comprises the following steps:

- providing a lower stack assembly 1 of a blowout preventer 10 for a hydrocarbon extraction well according to any one of the embodiments described above;
- providing a remotely operated vehicle 5;
- associating said remotely operated vehicle 5 with said port 4;
- transmitting a pilot signal to said first valve 3, whereby activating said at least one safety function 2.

According to a possible mode of operation, the aforesaid steps are to be provided in succession in the indicated order.

According to a possible mode of operation, said step of transmitting a pilot signal to said first valve 3, whereby activating said at least one safety function 2, is also performed in absence of connection between said assembly 1 and associable drilling means 18.

According to a possible mode of operation, said step of transmitting a pilot signal to said first valve 3, whereby activating said at least one safety function 2, is also performed in absence of connection between said assembly 1 and an associable lower riser marine package 20.

According to a possible mode of operation, said steps of associating said remotely operated vehicle 5 with said port 4 and transmitting a pilot signal to said first valve 3, whereby activating said at least one safety function 2, is performed by avoiding to build a circuitry.

According to a possible mode of operation, said step of associating said remotely operated vehicle 5 with said port 4 comprises the sub-step of using an articulated arm and a manipulator 17 of said remotely operated vehicle 5 to said port 4 and transmitting a pilot signal to said first valve 3, whereby activating said at least one safety function 2.

According to a possible mode of operation, said method comprises the further step of acting by means of said remotely operated vehicle 5 on said second valve control device 11, whereby opening said second valve 9. According to a possible mode of operation, this step is performed between the step of associating said remotely operated vehicle 5 with said port 4 and the step of transmitting a pilot signal to said first valve 3, whereby activating said at least one safety function 2.

According to a possible mode of operation, said method comprises the following further step of adjusting the fluid pressure let out from said at least one accumulator 7.

By virtue of the features described above, either mutually separately or jointly in particular embodiments, it is possible to obtain an assembly 1, a device 10 and a method which, at the same time, satisfy the aforesaid mutually contrasting needs and the aforesaid desired advantages, and in particular:

- it is reduced the risk related to the drilling operations in submerged environment;
- it is provided for a solution of lower stack 1 which is versatile and can be adapted to a wide range of LMRPs 20 present on the market;
- it is enabled a sharp reduction of the intervention time of the secondary emergency system;
- it is made possible to drive said first valve 3 with a low fluid flow rate, allowing it to be activated by the ROV 5 autonomously;
- it is made possible to make a permanent circuitry for the entire working life of the assembly 1 capable of activating the secondary emergency system in very timely manner, without because of this resulting in an excessively too bulky or poorly reliable circuitry;
- at the same time, it is avoided the need to construct the circuitry in emergency conditions, e.g. the need is avoided to connect an end of a flying lead when the lower stack 1 of the BOP 10 is not operatively or mechanically connected to the LMRP 20, e.g. due to bad weather and sea conditions or in conditions of absence of information on the location of the BOP 10 with respect to the drilling means 18;
- by proving said at least one third valve 12, preferably a selector valve, positioned along said first fluid connection 6, it is made possible to convey to the safety function 2 more circuitries adapted to activate the safety function 2, while makes it possible to enable them in selective manner; in this manner, by providing said at least one third valve 12, when said primary control system controls the activation of said safety function 2, said third valve is adapted to selectively intercept the flow of fluid coming from the accumulators 7;
- by providing said pressure regulator 14, pressurized fluid can be supplied having a pressure lower than the pressure at which the pressurized fluid is stored in the at least one accumulator 7, whereby avoiding damage to the circuitry components which require a process fluid at a pressure lower than the pressure of the fluid stored in the accumulators;
- providing an additional allows manual isolation valve present in said second fluid connection 8 makes it possible to isolate an accumulator or a group of accumulators in the event of malfunctioning;
- a high degree of modularity of the safety function activation circuitry is allowed;
- versatile assembly is provided, adapted to operate in different configurations, e.g. in dual-port configuration, in which a single port 4 manages the selective opening of two or more first valves which lead to respective safety functions, as well as single-port configuration, in which each port 4 manages the selective opening of a single valve and a single safety function;
- it is possible to avoid the spilling of the hydrocarbon extraction well contents even in conditions of where uncontrollable well blowout;
- the present invention provides an isolation system which prevents the uncontrolled spilling of product from a subsea hydrocarbon well;
- the present invention provides a system for rapidly activating the isolation system of a subsea well in situation of malfunctioning.

A person skilled in art may make many changes, adaptations and replacements to the embodiments described above or may replace elements with others which are functionally equivalent in order to satisfy contingent needs without however departing from the scope of protection of the appended claims.

LIST OF REFERENCES

1. Lower stack assembly, or BOP lower stack, or lower stack
2. Emergency function or shear ram
3. First valve
4. Port
5. Remotely operated vehicle, or ROV
6. First fluidic connection
7. Accumulator
8. Second fluidic connection
9. Second valve
10. Blowout preventer, or BOP
11. Second valve control device
12. Third valve
13. Control panel
14. Pressure regulator
15. Rigid pipeline
16. Wellhead connection element
17. ROV manipulator, or operative portion of the ROV
18. Drilling means
19. Riser
20. Lower riser marine package, or LMRP
21. Pipeline section

22. Third fluidic connection branch
23. Support vessel
24. ROV umbilical cord
25. Seabed
26. Water body
27. Ram abutment portion
28. Ram cutting portion
29. Structural frame of the assembly
30. Primary pod
31. Secondary pod
32. LMRP frame
33. LMRP pipeline end
34. Fourth valve
35. Emptying branch
36. Shut-off valve at accumulator outlet
37. Spilling of petroleum product from well
38. Casing
39. Drilling rod

What is claimed is:

1. A lower stack assembly of a blowout preventer for a hydrocarbon extraction well, the assembly comprising:

at least one safety function that can be hydraulically activated to rapidly cut off of a pipeline section;

at least one first valve;

at least one first fluidic connection that connects in permanent manner said at least one first valve and said at least one safety function, so that said at least one first valve is adapted to selectively intercept a flow of fluid directed towards said at least one safety function;

at least one port operatively connected to said at least one first valve, said at least one port being adapted to cooperate with a remotely operated vehicle to transmit a pilot signal to said at least one first valve;

at least one accumulator, adapted to house pressurized fluid; and at least one second fluidic connection between said at least one accumulator and said at least one first valve, so that by cooperating with at least said at least one first valve said at least one accumulator is adapted to supply pressurized fluid, by said at least one second fluidic connection and said at least one first fluidic connection, to said at least one safety function in order to activate it, wherein said at least one second fluidic connection is formed by at least one rigid pipeline and connects in permanent manner said at least one accumulator and said at least one first valve, so that said at least one second fluidic connection remains operative during the entire working life of the assembly, wherein said at least one second fluidic connection remains operative also in case of detachment of a lower marine riser package associable with said lower stack assembly, wherein said at least one first fluidic connection comprises at least one second valve, wherein said at least one second valve is adapted to intercept a flow of fluid coming from said at least one accumulator and/or directed towards said at least one safety function, and wherein said at least one second valve is controlled by a second valve control device, and wherein said assembly further comprises at least one control panel comprising said at least one port and said second valve control device, so that said remotely operated vehicle is adapted to simultaneously cooperate both with said at least one port and with said second valve control device to control said first valve and said second valve, respectively, to activate said at least one safety function.

2. The lower stack assembly of claim 1, wherein said at least one second valve is a shut-off valve, and wherein said second valve control device is controlled independently from said at least one port.

3. The lower stack assembly of claim 1, wherein said at least one port is associated with a pilot valve, adapted to provide a pilot signal to said at least one first valve, wherein said pilot signal is a flow of fluid, wherein said pilot signal is a flow of fluid having a pressure lower than the pressure of the fluid housed in said at least one accumulator, wherein said lower stack assembly comprises a third fluidic connection branch that forms a permanent fluidic connection between said at least one port and said at least one first valve, wherein said at least one first valve is a pilot-operated valve, wherein said at least one first valve is a ball check valve or slide valve, and wherein said pilot signal is an electric signal.

4. The lower stack assembly of claim 1, wherein said second permanent fluidic connection comprises at least one pressure regulator which regulates the pressure of the fluid let out from said at least one accumulator, and said at least one pressure regulator decreases the pressure of the fluid let out from said at least one accumulator.

5. A blowout preventer for a hydrocarbon well, the blowout preventer comprising at least one lower stack assembly of claim 1.

6. The blowout preventer of claim 5, further comprising at least one lower marine riser package removably connected to said at least one lower stack assembly and, by a riser, to drilling means associated with said blowout preventer.

7. A method for activating a safety function for rapidly cutting off a pipeline section, the method comprising the steps of:

providing a lower stack assembly of a blowout preventer for a hydrocarbon well according to claim 1;

providing a remotely operated vehicle;

associating said remotely operated vehicle with said at least one port;

acting by said remotely operated vehicle on said second valve control device, whereby opening said second valve;

transmitting a pilot signal to said at least one first valve, whereby activating said at least one safety function, thus avoiding to connect said at least one accumulator to said at least one first valve, said at least one second fluidic connection being permanently connected to said at least one accumulator and to said at least one first valve; and keeping said second fluidic connection operative during the entire working life of the lower stack assembly; and said step of transmitting a pilot signal to said first valve, whereby activating said at least one safety function, is also performed in absence of connection between said assembly and an associable lower riser marine package.

8. The method of claim 7, further comprising a step of acting by said remotely operated vehicle on said second valve control device whereby opening said second valve, said step being performed between the step of associating said remotely operated vehicle with said at least one port and the step of transmitting a pilot signal to said at least one first valve, whereby activating said at least one safety function.

9. A lower stack assembly of a blowout preventer for a hydrocarbon extraction well, the assembly comprising:

at least one safety function configured to be hydraulically activated to rapidly cut off a pipeline section;

at least one first valve;

at least one first fluidic connection between said at least one first valve and said at least one safety function, so that said at least one first valve is adapted to selectively intercept a flow of fluid directed towards said at least one safety function;

at least one port operatively connected to said at least one first valve, said at least one port configured to transmit a pilot signal to said at least one first valve;

at least one accumulator, adapted to house pressurized fluid; and at least one second fluidic connection between said at least one accumulator and said at least one first valve, so that said at least one accumulator is adapted to supply pressurized fluid, by said at least one second fluidic connection and said at least one first fluidic connection, to said at least one safety function to activate it, wherein said at least one first fluidic connection comprises at least one second valve, wherein said at least one second valve is adapted to intercept a flow of fluid from said at least one accumulator and/or directed towards said at least one safety function, and wherein said at least one second valve is controlled by a second valve control device, and wherein said assembly further comprises at least one control panel comprising said at least one port and said second valve control device, so that a remotely operated vehicle positioned adjacent said control panel is configured to manipulate said at least one port and said second valve control device to activate said at least one safety function.

* * * * *